US006352048B1

(12) United States Patent
Scott

(10) Patent No.: US 6,352,048 B1
(45) Date of Patent: Mar. 5, 2002

(54) DOLL BOOKMARK

(76) Inventor: Sylvia Scott, 1637 Westway Dr., Charleston, SC (US) 29412

( * ) Notice: Subject to any disclaimer, the term of this patent is extended or adjusted under 35 U.S.C. 154(b) by 31 days.

(21) Appl. No.: 09/630,502

(22) Filed: Aug. 2, 2000

(51) Int. Cl.[7] ..... B42D 9/00

(52) U.S. Cl. ..... 116/238; 116/237; 116/239; 281/42

(58) Field of Search ..... 116/234–240; 281/42; D19/34

(56) References Cited

U.S. PATENT DOCUMENTS

| | | | | | |
|---|---|---|---|---|---|
| 1,894,533 | A | * | 1/1933 | Dempsey | 116/238 |
| 1,961,527 | A | * | 6/1934 | Petro | 116/238 |
| 2,394,372 | A | * | 2/1946 | Evans | 116/238 |
| 2,664,847 | A | * | 1/1954 | Orman | 116/239 |
| 4,434,535 | A | | 3/1984 | Woodley | |
| 4,569,538 | A | | 2/1986 | Kurschner | |
| 4,838,198 | A | | 6/1989 | Knox | |
| 4,848,799 | A | | 7/1989 | Turetsky | |
| 4,934,304 | A | * | 6/1990 | Rosen | 116/234 |
| 5,022,342 | A | | 6/1991 | Davis | |
| 5,095,846 | A | | 3/1992 | Knight | |
| 5,103,758 | A | | 4/1992 | Clark | |
| 5,244,232 | A | | 9/1993 | Dulberger | |
| 5,375,884 | A | | 12/1994 | Farrington | |
| 5,408,950 | A | * | 4/1995 | Porto | 116/239 |
| 5,443,029 | A | * | 8/1995 | Garnet | 116/235 |
| 6,073,966 | A | | 6/2000 | Warren | |

* cited by examiner

*Primary Examiner*—Andrew H. Hirshfeld
(74) *Attorney, Agent, or Firm*—Harleston Law Firm; Kathleen M. Harleston

(57) ABSTRACT

A bookmark in the shape of a doll or animal includes: a) a rounded head portion; (b) a longitudinally extending body portion attached at an upper end to the head portion, the body portion including at least two generally rigid, matching leg portions extending downwardly at a lower end; and (c) at least one strand of hair-like material attached to the head portion. The leg portions are spaced apart and adapted for placement over the edge of a cover of a book or other text. The strands are of a length and thickness adapted for placement between two pages of the book to mark one or more pages for future reference. A head swivel mechanism is also described.

14 Claims, 8 Drawing Sheets

DOLL BOOKMARK

BACKGROUND OF THE INVENTION

1. Technical Field

This invention relates to bookmarks which are removably attachable to a book, more particularly to a decorative, reusable bookmark in the shape of a doll or animal adapted for holding one or more places in a book or other type of text.

2. Background Information

A variety of methods have been used to mark one's place while reading a book, or to mark frequently used sections in a reference text. These include simply turning down the corner of the desired page in the book, placing a loose slip of paper or a "stick-on" note in the appropriate place, leaving a pencil between the pages in the text, or placing a commercially available bookmark in the text. None of these are ideal. It is undesirable to bend the corners of pages, and difficult to find a page with a bent corner in a book, especially where several pages have bent corners. A pencil can also damage a book, and often rolls out of the book so that the page is lost. Flat, commercially available bookmarks are often hard to find when you need them. Slips of paper and commercially available bookmarks are easily lost when they fall out of the book. Many Bibles have colored ribbons sewn at the top of the spine for marking favorite passages, but this adds expense to the cost of a book, and ribbons are not commonly available in books other than Bibles.

The doll bookmark of the present invention is aesthetically pleasing and effective for marking one's place or places in any book. Designed to resemble a doll, it comes in a variety of styles and has a number of special features. The legs of the doll straddle a book's cover, while the doll's strands or braids of hair are used to mark the desired place(s) in the book. This doll bookmark does not bend pages, or easily slip out of a book. It is clipped on the book, so it is not easily lost and can be kept at the ready. It is inexpensive to produce, and can be reused on different books. It can be used on all sorts of texts, including binders, manuals, booklets, and books, including hardbacks and paperbacks. It can also be used for holding signs, recipe cards, flashcards, etc.

The present invention is a reusable decorative bookmark which resembles a small wooden doll with long hair. This doll bookmark includes: a wooden doll-type body with legs and a round head with attached hair or ribbons and other ornamentation. The space between the doll's base (legs) can be narrowed or widened to accommodate a variety of book cover thicknesses. Using this bookmark, it is easy to return to a previous passage in the same book, or access a desired section of a reference book. Constructed of sturdy materials, the present bookmarks withstand the type of treatment associated with the normal use and transport of books.

Many commercially available bookmarks have prongs which slide over the pages of the book. These slide off the book relatively easily and may tear the pages. A unique feature of the present doll bookmark is that the doll's legs clip onto a book's cover and the doll's hair, or attachments to the doll's hair, are placed on or between the pages, providing a dual method of securing the bookmark to the book. In addition, the doll bookmark of the present invention is generally larger than most bookmarks and is not as easy to lose.

The doll bookmark is appealing to children, especially young girls, and may arouse their curiosity and elicit greater interest in reading. Because of the availability of a variety of styles and colors, parents and grandparents may choose doll bookmarks which bear some resemblance to their children or grandchildren, thus attracting the child's attention, increasing their curiosity, and indirectly encouraging the child to read. The doll bookmark could be sold in a kit with books featuring a story about that particular doll. These doll bookmarks can feature particular characters in traditional stories, such as a Cinderella doll bookmark on a Cinderella book, to further encourage fantasy and stimulate the child's creative imagination. These doll bookmarks may be used to animate and embellish bedtime stories. Doll bookmarks may be used on school books as well and may become a topic of conversation with school friends. The present doll bookmark can be transported with the book to school, on a trip, or to a friend's house.

BRIEF SUMMARY OF THE INVENTION

The present invention is a bookmark in the shape of a doll or animal, comprised of:

(a) a rounded head portion;

(b) a longitudinally extending body portion attached at an upper end to the head portion, the body portion comprising at least two generally rigid, matching leg portions extending downwardly at a lower end, the leg portions being spaced apart and adapted for placement over the edge of a cover of a book or other text; and (c) at least one strand of hair-like material, each strand having one end attached to the head portion, the strands being of a length and thickness adapted for placement between two pages of the book to mark one or more pages for future reference.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
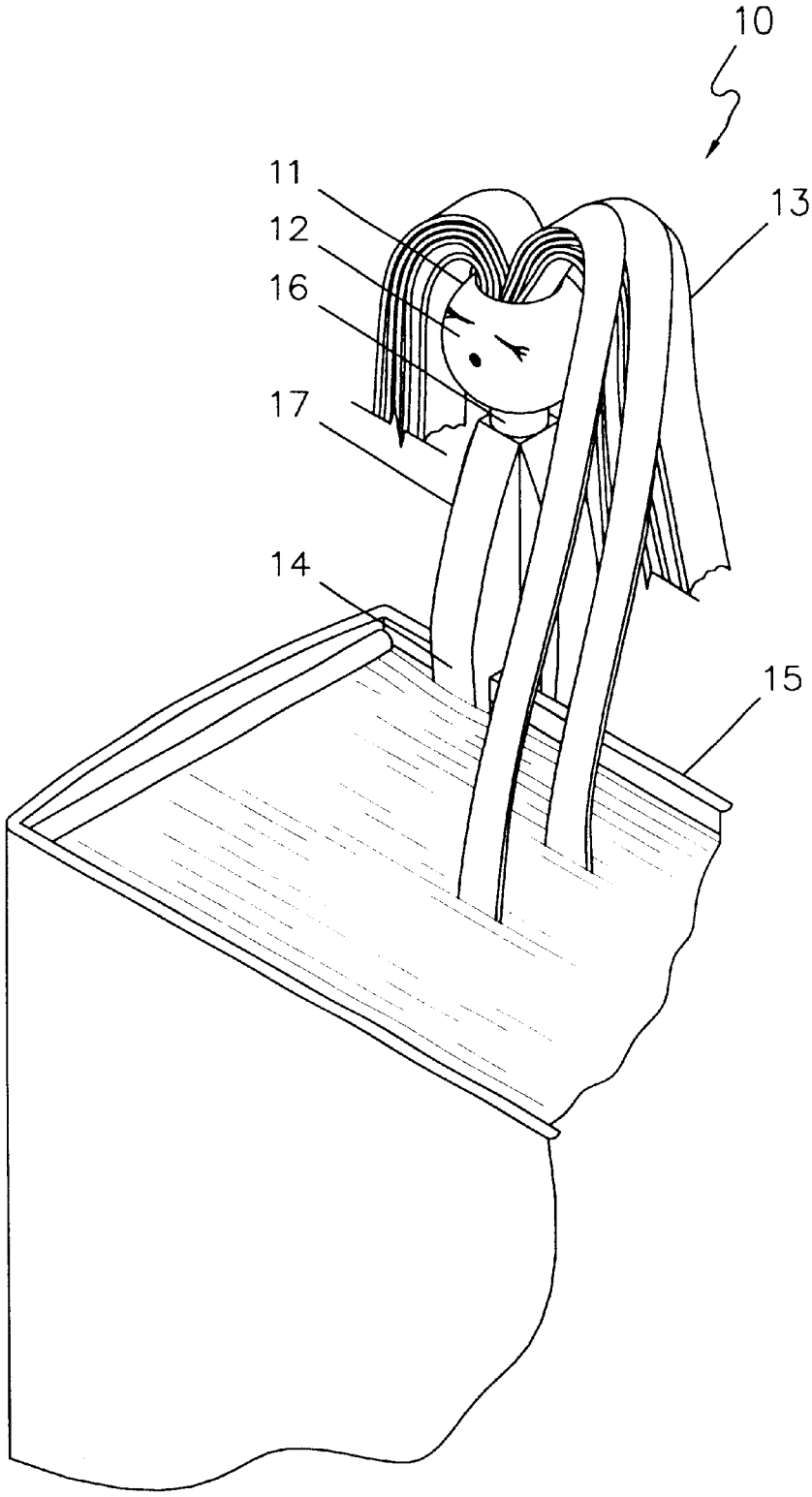
FIG. 1 shows a perspective view of a doll bookmark according to the present invention, shown in use.

In the following description, like reference characters designate like or corresponding parts throughout the several views. Also, in the following description, it is to be understood that such terms as "front," "back," within," and the like are words of convenience and are not to be construed as limiting terms. Referring in more detail to the drawings, the invention will now be described.

Referring to FIG. 1, a doll bookmark 10 is shown with its legs straddling the rear cover of a book. The strands of hair are used to mark pages in the book. The bookmark is comprised of a generally rounded head portion 11 with a painted face 12, at least one and preferably a plurality of strands of hair 13, and two or more generally rigid leg portions 14. The bookmark 10 is shown attached to the rear cover of a book 15. In the preferred embodiment shown in FIG. 1, the bookmark is constructed of wood, with ribbon "hair" fastened to the head. Beneath the head portion 11 is the doll's neck portion 16. One end of the neck portion extends upward into the doll's head portion 11 and the other end is attached to the body of the doll. The chest area 17 is connected to four leg portions 14 which extend downward and are curved slightly outward at the bottom. The doll's head portion 11 is preferably symmetrical and generally round in shape. However, the head could be oval, heart-shaped, etc.

Continuing to refer to FIG. 1, the strands of hair 13 are permanently affixed to the end of a clip in the head portion of the doll. The hair strands preferably lay flat against the surface of the reading material so that it is easy to close the book over the strands. The doll's decorative hair 13 may be made from a variety of materials. Many colors and styles are available. The hair may be long or short, straight or curly, and braided or not. Short hair is more suitable for use in paperbacks, and long hair is more suitable for use in long books because the ends of the long hair are visible projecting from the base of the book. Yarn, cord, braided material, ribbons, and other suitable materials may be used to form the strands of hair. The ribbons or braids are generally brightly colored. The colors may be chosen to symbolize various groups or organizations. Ribbon colors may be selected which correspond to the colors of a country's flag, school colors, school sorority, or holidays, such as the Fourth of July, Easter, Thanksgiving, or Christmas. A line of doll bookmarks from different countries may include painted-on clothing, for example. The ribbons may be plaid, checked, or printed with other symbols such as stars, animals, or other symbolic shapes. The word "doll" is meant to include animals, mythical creatures, and the like, in addition to human-like figures, when used herein.

The doll bookmark 10 may be adapted for attachment to sheaves of music, or to mark certain pieces while the band plays during football games or other sports events. When not in use, the doll bookmark 10 may be perched on computers, mirrors, picture frames, medicine cabinets, etc. It can function as both a toy and a bookmark.

Figure 2:
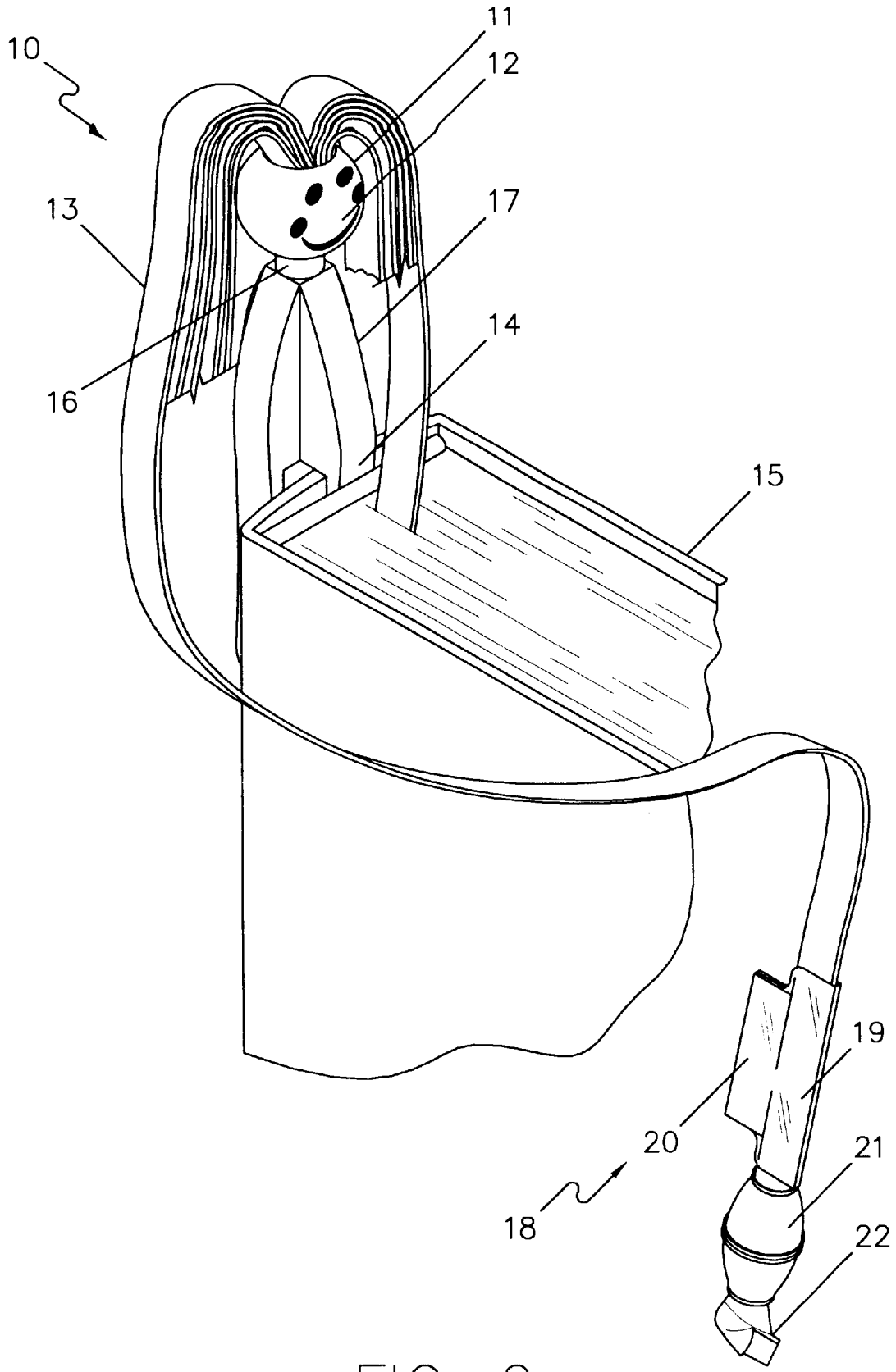
FIG. 2 is a perspective view of an alternate embodiment of a doll bookmark according to the present invention, shown in use.

Referring to FIGS. 1 and 2, the face 12 may be painted or glued on in various ways. The doll's eyes can be open or shut, and eye color may vary. The face may include rosy cheeks, makeup, and various mouth shapes, such as a small, O-shaped mouth or a big clown smile. Hair colors and styles vary and may include buns, braids, pigtails, ponytails, and dreadlocks. Decorations such as feathers, clips, bows, beads, and barrettes, and hats or caps, may be included in or on the doll's hair. While the hair 13 is used to mark the desired pages in a book, the doll's body is firmly but removably attached to the book's cover 15. Thus, movement is restricted so the bookmark 10 is unlikely to fall off the cover. Since the doll's hair 13 preferably does not clip onto the pages, no harm is done to the pages.

In FIG. 2, a doll with a different painted face is shown removably affixed to a book's spine. The leg portions are shown straddling the book's cover at the spine, with one leg portion inserted between the cover and the binding. A strand of hair is shown marking one page.

Figure 3:
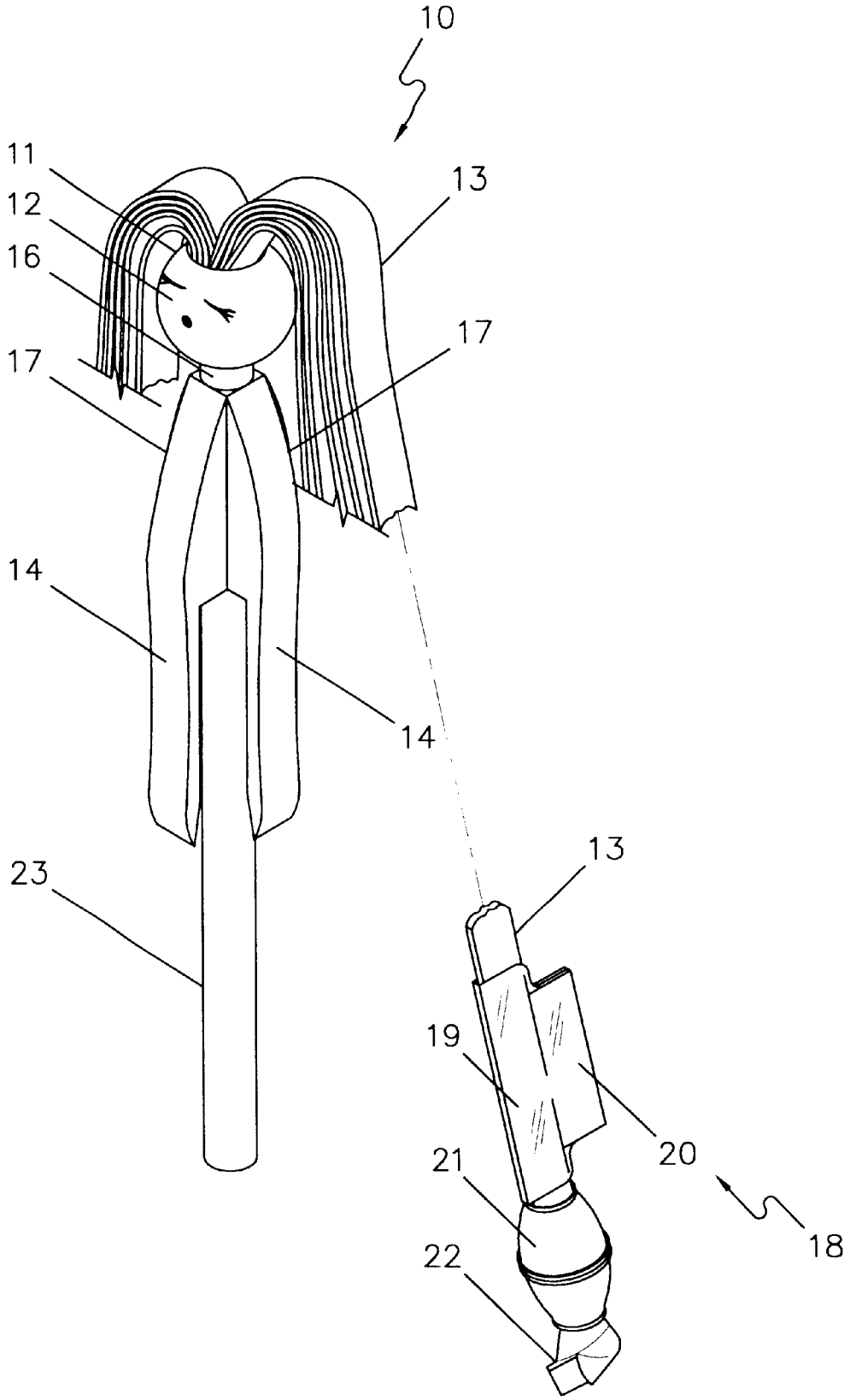
FIG. 3 is a perspective view of the doll bookmark according to FIG. 2.

In the embodiments shown in FIGS. 2 and 3, each strand of hair 13 has a tab attachment 18 attached to the end of the strand. The tab attachments 18 are permanently affixed to the strands of hair on the attachment portion 19 of the tab attachment. The tab attachments may alternatively be attached along the middle of the hair strand. Names of the books of the Bible, chapter numbers, recipe categories, or other identifying information may be written on tabs of paper that are inserted into the tab-holding portion 20 of the tab attachment 18. While the tab attachment 18 may be used to mark one section of the book, other strands of hair 13 may be used to mark different places in the book at the same time. In this embodiment, the hair 13 is decorative ribbon. Regardless of the type of hair, the ends of each strand of hair may be decorated with ornamental beads 21, whether or not the tab attachments are present. Any suitable beads may be employed. The ornamental beads 21 can be secured in place by knots 22 tied in the ends of the strands of hair 13. The tab attachment 18 may be attached to any number of the doll's strands of hair 13, and can be included with or without beads 21.

Continuing, with FIG. 3, the doll bookmark may include a rounded central wooden peg, called here a handle portion 23. It forms a shaft in the center of the doll's body. The central handle portion 23 can be long, to facilitate carrying the bookmark around and alternate uses, or short, i.e., the same length as the leg portions. A child with a number of different dolls, for example, may choose to play with them by clipping them onto a cardboard box or sheet to hold them upright. The longer handle portion 23 would facilitate this type of play.

Figures 4, 5, 6:
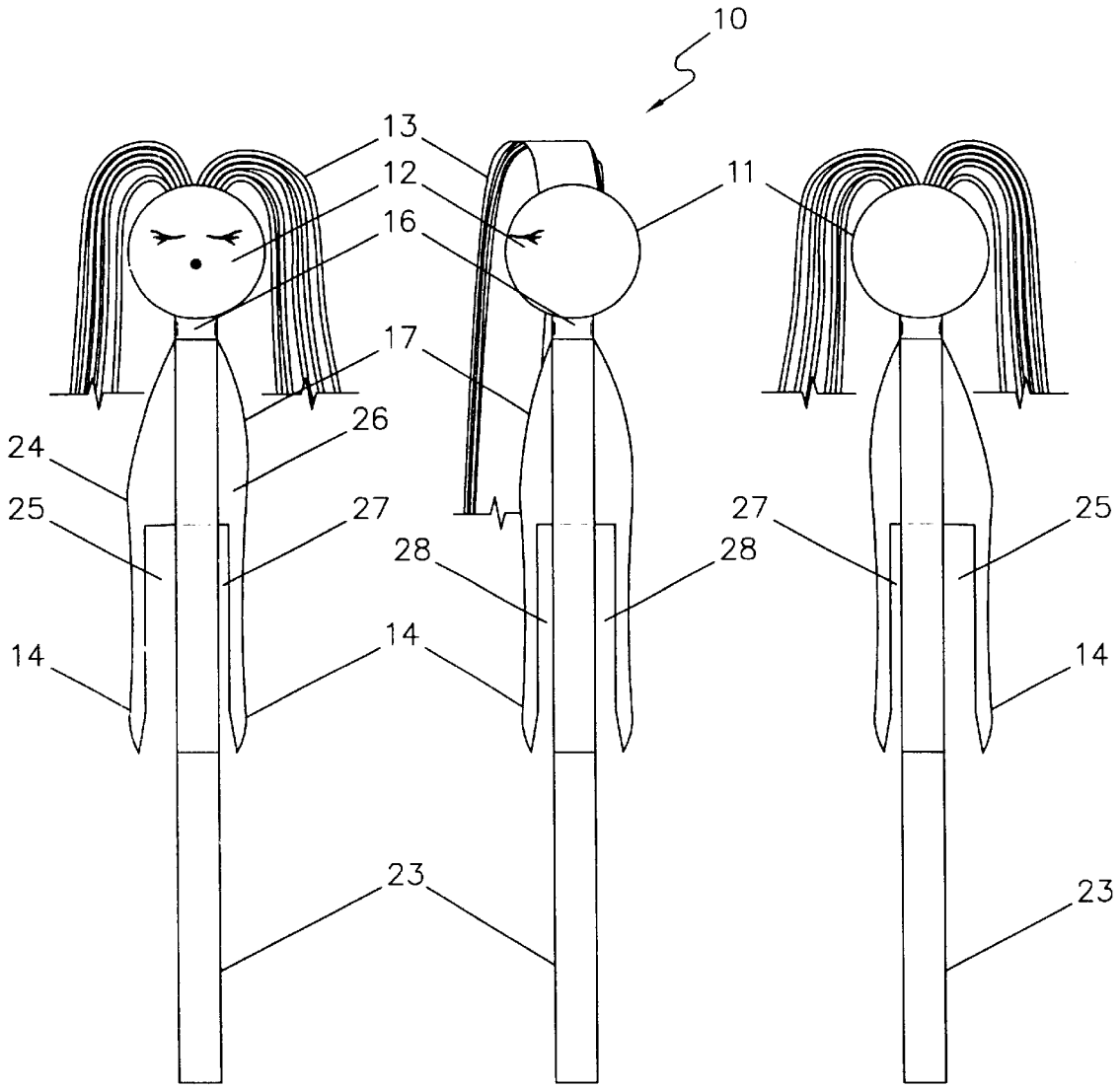
FIG. 4 is a front elevational view of an alternate embodiment of a doll bookmark according to the present invention.
FIG. 5 is a side elevational view of the bookmark shown in FIG. 4.
FIG. 6 is a back elevational view of the bookmark shown in FIG. 4.

As illustrated in FIGS. 4–6, one embodiment of the doll bookmark 10 has four leg portions 14, which are attached in the chest area 17 to a central handle portion 23 forming a shaft in the center of the doll's body. The upper portion of the handle portion 23 forms the doll's neck portion 16. Any one of the four leg portions 14 may be slipped over the book cover 15, depending upon the thickness of the cover. The distance between the leg portions 14 and the center handle portion 23 varies as shown in FIGS. 4–6. In FIGS. 4–6, the front torso area 24 extends outwardly towards the front of the doll a greater distance, which provides a greater space 25 between the doll's leg portion 14 and the central handle portion 23. This wider space 25 is used with thick book covers 15. The back side of the torso area 26 does not extend as far out towards the back as the front chest area extends toward the front. The thinner space 27 between the back torso area 26 and the centrally located handle portion 23 is used for books with thin covers 15, or a booklet or notecards, for example. The two leg portions 14 at the sides of the doll form medium-sized spaces 28 between the leg portions 14 and the handle portion 23. The medium-sized spaces 28 are preferably slightly different than each other. Thus, in this embodiment a variety of book cover thicknesses are readily accommodated.

The bookmark 10 is most preferably between about three and eight inches long. The head, which is the widest point, has a diameter of between about ¾ and 1½ inch. The legs are most preferably between about one and four inches long. The widest space 25 between the legs is most preferably between about five millimeters and one centimeter wide. The medium spaces 28 are most preferably between about two and five millimeters wide. The thinnest space 27 is most preferably between about one and three millimeters wide.

Figure 7:
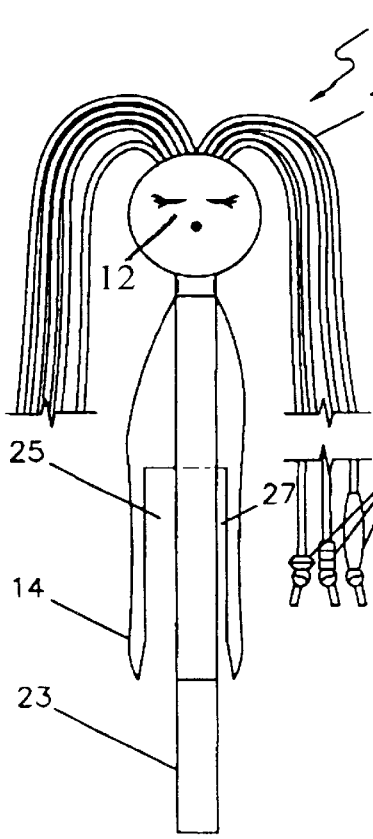
FIGS. 7–9 are front elevational views of three alternate embodiments according to the present invention.
Figure 8:
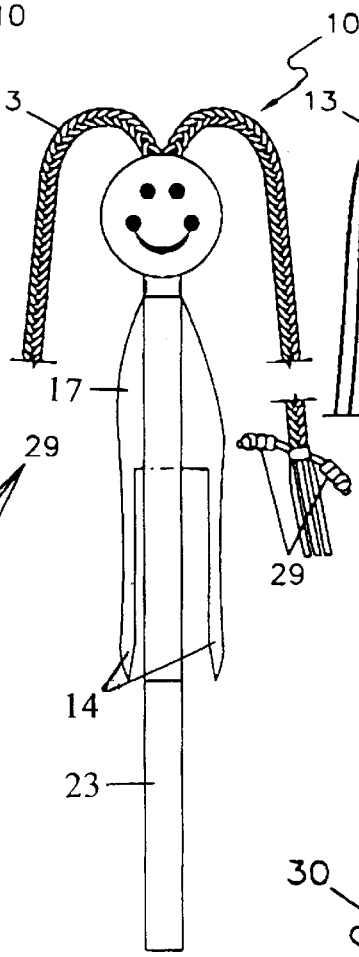
Figure 9:
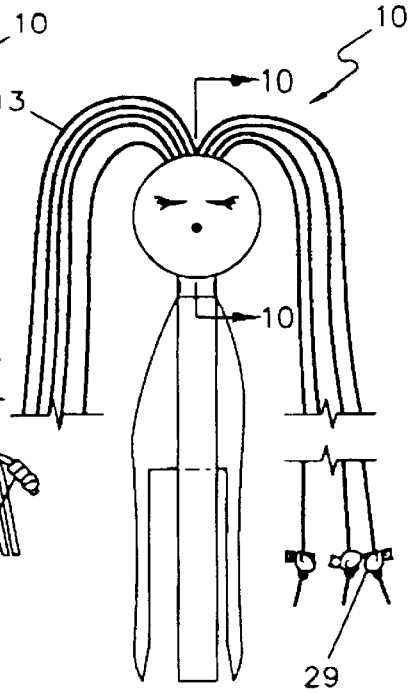

As illustrated in FIGS. 7–9, a variety of painted faces 12, hairstyles, and ornamental beads or other hair accessories 29 may be used to create dolls with different appearances. The ornamental accessories 29 may be shaped like hearts, stars flowers, butterflies, or musical instruments. The hair 13 may be a thick material, as shown in FIG. 7, or a thin material, as shown in FIG. 9. The hair 13 is also available in a wide variety of colors and styles, achieving different looks that appeal to different people. A simple braid is illustrated in FIG. 8. The doll bookmark 10 can be clipped onto a book cover on the front, back, or spine of the book 15. Also, in the embodiments shown in FIGS. 7–9, the doll's head portion 11 can be swiveled to the right or to the left, so that the doll's face may be kept facing in the desired direction regardless of whether it is attached to a book.

Figure 10:
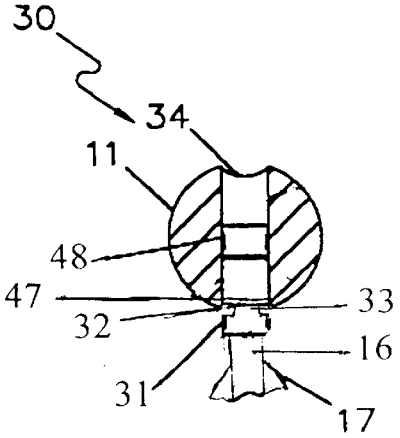
FIG. 10 is a cross-sectional view of the head and upper neck portions of a bookmark according to the present invention.

Referring to the cross-section shown in FIG. 10, a head swivel mechanism 30 is illustrated. In using the bookmark, the user first chooses the size space (25, 27, 28) between the leg portions 14 and the center handle portion 23 that best accommodates the width of the book's cover 15. Depending on whether the wide 25, narrow 27, or two medium sized 28 spaces are used, the doll's head portion 11 may not be facing in the desired direction. The head swivel mechanism 30 allows the user to point the doll's face 12 in the desired direction, e.g. towards the reader. To change the orientation of the doll's head portion 11, the head portion is lifted and rotated. Once the doll's head portion 11 is properly oriented in the desired direction, the head portion is dropped back down, which prevents further rotation.

Continuing with FIG. 10, basically two portions are shown: the head portion 11 and the neck portion 16. The neck portion is preferably the anterior end of the center handle portion 23. Beginning at the top, the anterior end of the neck portion comprises a rounded upper end 33 with a flange 47 attached to it at the top. The flange is adapted for holding the head portion on the neck portion. Beneath, and adjacent to, the rounded upper end is a squared neck portion 31, which resembles a peg. Beneath, and adjacent to, the squared neck portion is the bottom of the rounded neck portion, which continues into the chest area 17. Below the chest area are the leg portions and the center handle portion. The head is loosely connected to the neck portion. It is prevented from coming off the neck by the flange on the rounded top portion 33. The head portion comprises a central channel and a generally square-shaped aperture 32 adapted for loosely receiving the squared neck portion. The flange has a greater diameter than the square aperture, so the head will not come off. The head portion is adapted for rotation about the neck portion. Above the flange is a flange stop 48. The flange stop fits into the central channel in the head portion above the flange and at the base of the hole 34. The function of the flange stop 48 is to prevent the flange from pushing against the ends of the hair strands in the hole 34.

With regard to FIG. 10, the head swivel mechanism 30 includes the squared neck portion 31 on the doll's neck portion 16, and the square aperture 32 in the doll's head. The square aperture 32 in the doll's head will slide over the square neck portion 31 when properly aligned, allowing the head portion 11 to be lifted and rotated around the rounded top portion 33 of the neck portion. When the head is in the desired position, it may be dropped back down, again fitting the square neck portion 31 through the square aperture 32 in the doll's head. FIG. 10 also illustrates the hole 34 at the top of the doll's head portion 11 into which the ends of the hair 13 are inserted for attachment. The ends of the strands are preferably glued into the hole 34.

Figure 11:
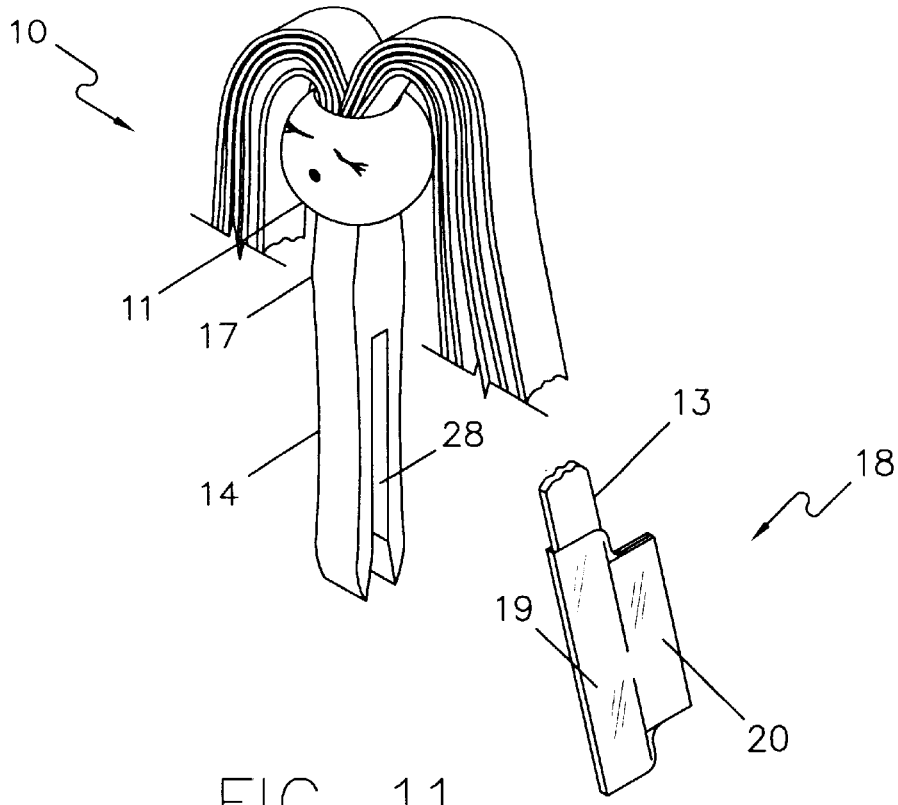
FIG. 11 is a perspective view of an alternate embodiment of the bookmark according to the present invention.
Figure 12:
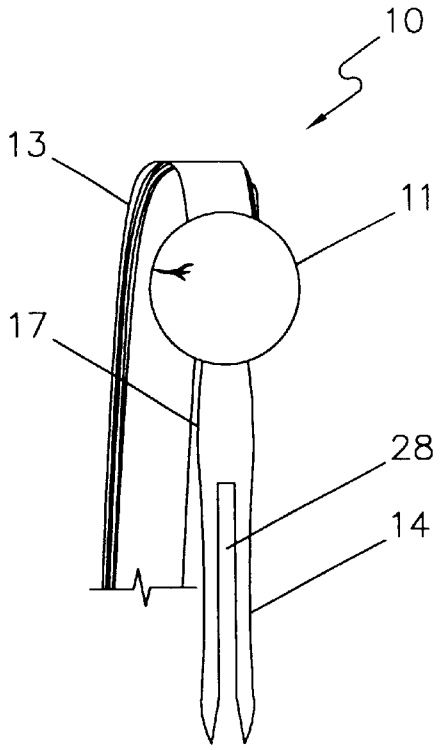
FIG. 12 is a side elevational view of the bookmark shown in FIG. 11.
Figure 13:
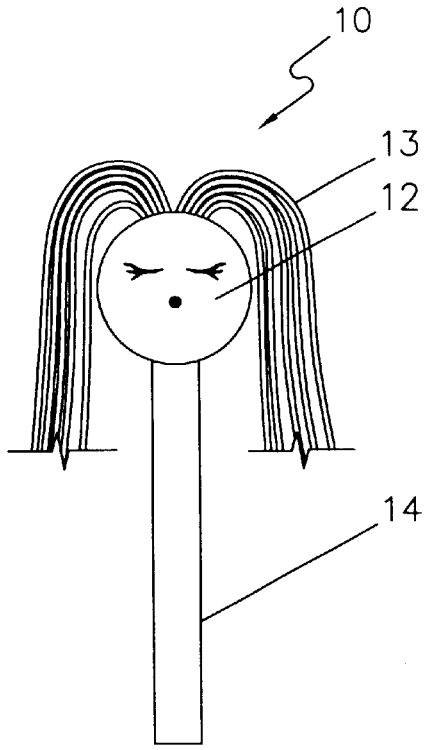
FIG. 13 is a front elevational view of the bookmark shown in FIG. 11.

Referring to FIGS. 11–13, a simpler embodiment of the doll bookmark is illustrated. This bookmark has a head portion 11, and an upper chest area 17 which splits into two leg portions 14 with a space 28 between them. To use the bookmark 10, the user simply slides the leg portions onto a book's front or back cover 15 or spine, with one leg portion in front of the cover and one behind. The lower end of the doll's leg portions 14 are farther apart, so the doll bookmark 10 slides farther down onto more narrow book covers 15 win comparison to thicker covers. Various embodiments have leg portions 14 of different lengths and with wider or narrower spacing between the leg portions. Tab attachments 18 that attach to the strands of hair, different styles of hair 13, and ornamental hair accessories 21, 29 are available options.

Figure 14:
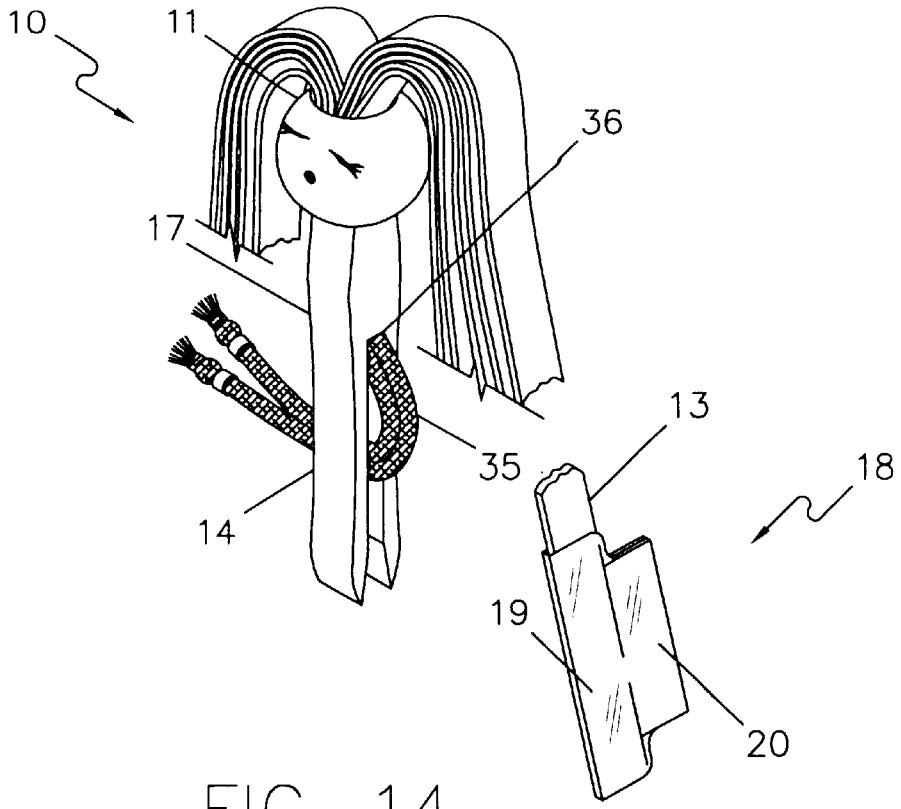
FIG. 14 is a perspective view of an alternate embodiment of the bookmark according to the present invention.
Figure 15:
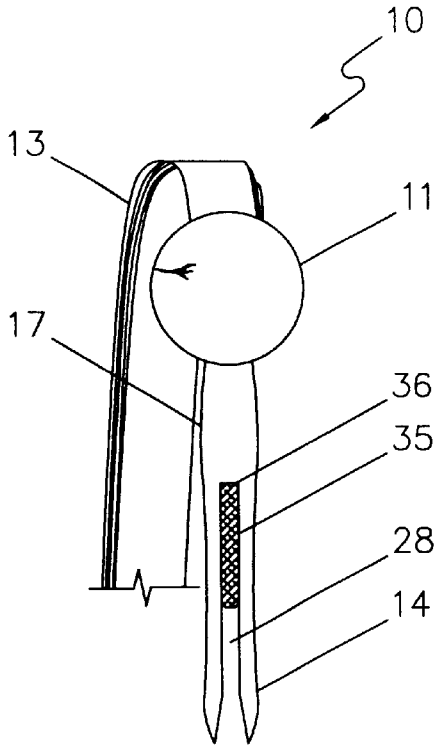
FIG. 15 is a side elevational view of the bookmark shown in FIG. 14.
Figure 16:
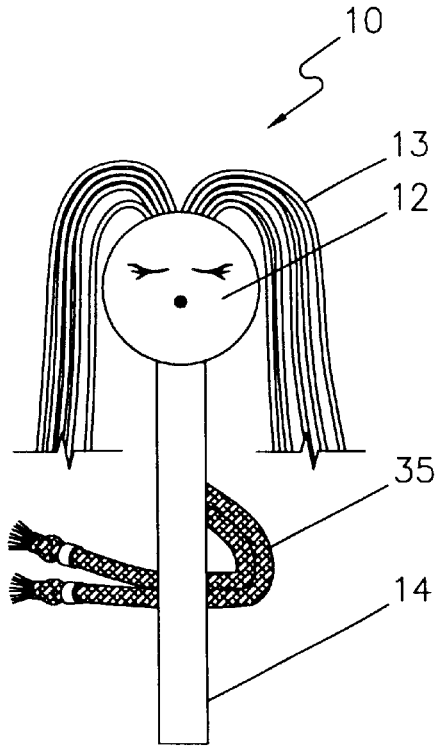
FIG. 16 is a front elevational view of the bookmark shown in FIG. 14.

Another embodiment shown in FIGS. 14–16 uses an adjustment cord 35 to decrease the width of the space between the doll's leg portions and allow adjustment to fit various book cover thicknesses. The adjustment cord preferably is two short strands, or one longer strand folded in the middle, of a suitable material. The cord strands are preferably attached at their upper ends to the juncture 36 of the two leg portions 14, i.e., the top of the space. When the bookmark is not in use, the adjustment cord hangs freely between the leg portions. The cord may be made from the same material as the bookmark's hair strands. One or both of the short strands of the adjustment cord 35 may be used to decrease the relative amount of space between the doll's leg portions 14 for a thinner book cover. When the fixed distance between the doll's leg portions 14 is greater than the width of the book cover 15, sliding the short strands of the adjustment cord 35 between the doll's leg portion 14 and the book's cover 15 creates a snug fit for the doll bookmark 10 and ensures that the bookmark does not slide off. Since the distance between the doll's legs is greater at the bottom, the degree of snugness may also be adjusted by altering how high the adjustment cord is pulled up from the bottom of the dolls' leg portions 14. When a thicker book cover 15 is used, the cord simply hangs freely as an added decoration. The upper end of the adjustment cord can alternatively be connected up through a central channel in the doll body to the attached ends of the hair, which are inserted in the hole 34 on the top of the head portion.

The bookmark of the present invention can also be used to hold the pages of a book open for hands-free reading. A number of pages of text can be clipped to the back or front cover of the book using this bookmark. A user grips opens the book to the desired page, clasps the pages on the left or right of the book to the front or back cover, and slides the bookmark of the present invention over them. The book can then be propped up for reading while the user's hands are otherwise engaged. The wide-space setting of the embodiment shown in FIGS. 4 and 6, and the embodiment shown in FIGS. 14–16, are especially useful for this purpose. The present doll bookmark can be used, for example, to hold a recipe or hobby book or instructional manual open while cooking, building a model, putting together a bicycle, etc.

Figure 17:
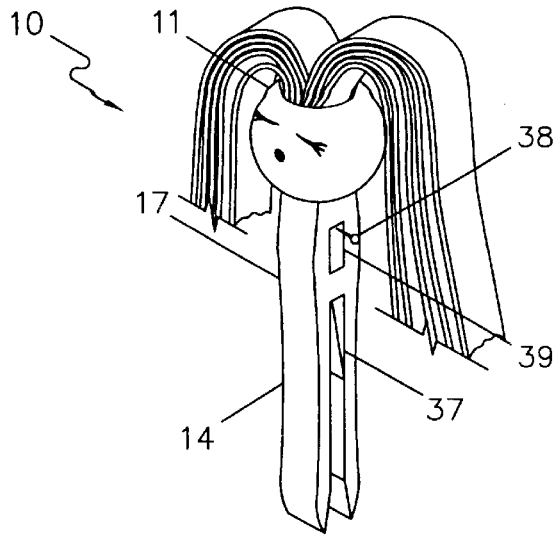
FIGS. 17 and 18 are perspective views of an alternate embodiment of a doll bookmark according to the present invention, showing the adjustment lever in up and down positions.
Figure 18:
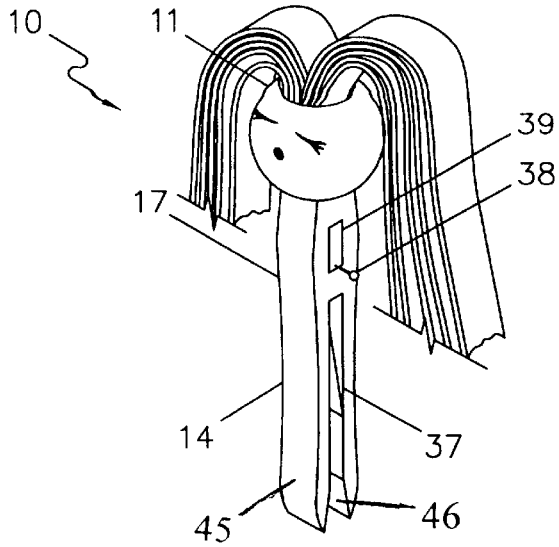

Referring to FIGS. 17 and 18, another embodiment of the present invention is shown. This "pin/lever" embodiment includes two identical leg portions 14 continuous at their top ends with the hollow chest area. A wedge-shaped adjustment lever 37 extending from the hollow chest area can be moved up or down to increase or decrease the space between the legs 14. This narrows or widens the space between the leg portions 14. This is done so that a single bookmark can conform to book/text covers 15 of varying widths. In the up position, which is shown in FIG. 17, the device 10 can accommodate a thicker book cover or booklet. In the down position, as shown in FIG. 18, the device will not wobble when placed on a thinner book or booklet. The adjustment lever 37 can be moved by pushing an adjustment pin 38 up or down in its slot 39. The adjustment pin extends through the slot 39, which is in the side chest area 17 of the device, and is connected at one end to the top of the adjustment lever. Any similar mechanism for closing off the space between the legs is included herein. Each leg portion 14 has a flat outer face 45 and a flat inner face 46. As in many of the previous embodiments, the outer faces 45 face in opposite directions (north and south). Each leg portion has a flat inner face which is parallel to and faces the flat inner face of the other leg portion.

Figure 19:
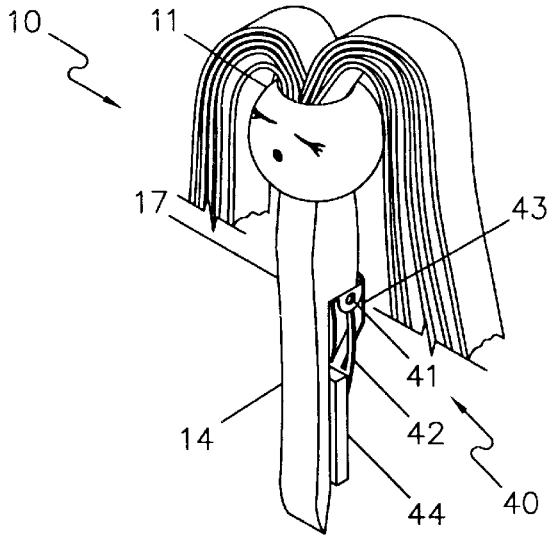
FIGS. 19 and 20 is a perspective view of an alternate embodiment of a doll bookmark according to the present invention, showing the clasp mechanism in closed and open positions.
Figure 20:
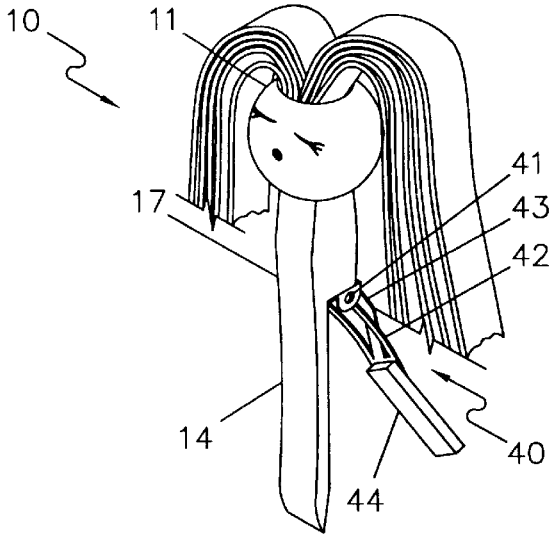

Referring to FIGS. 19 and 20, another embodiment of the present invention is illustrated. This "clasp" embodiment has one leg portion attached to the body portion by a hinged clasp mechanism 40, which is adapted for moving the leg portion from an open position to a closed position. The closed position is adapted for grasping the book cover between the leg portions. The device 10 is shown in a closed position in FIG. 19, and in an open position in FIG. 20. The clasp mechanism comprises a base section 41, two arm members 42, and a stop 43. One end of each arm is hinged to each side of the base section 41, which is attached to the base of the leg portion. The opposite ends of the arm members 42 are affixed to one end of a leg segment 44. In use, a user snaps the clasp mechanism 40 up to open it, then snaps it down over the book cover so that the fixed leg portion 14 is on one side of the book cover and the leg segment is on the other side of the book cover. The stop 43, which is affixed to the end of the leg segment 44 between the two arm members 42, holds the clasp mechanism open until the user closes it. In a closed, unused position, the inner face of the leg segment 44 lies against the inner face of the leg portion 14.

In sum, the longitudinally extending body portion is attached at an upper end to the head portion, and the body portion comprises at least two generally rigid, matching leg portions extending downwardly at a lower end. The leg portions are spaced apart and adapted for placement over the edge of a cover of a book or other text. The body portion preferably further comprises a neck portion at its upper end, and the head portion is movably coupled to the neck portion. Preferably, each leg portion has a generally flat inner face that is parallel to and faces the generally flat inner face of the other leg portion. The leg portions preferably extend from the body portion so as to converge to an open end and to be resiliently spread when the leg portions are pushed over the cover of the book or other text, with one leg portion on either side of the book cover. The bookmark is preferably one-piece or two, and made of wood or plastic or the like.

A head swivel mechanism (see above) can be included with any embodiment of the present invention. The mechanism includes: (a) a neck portion which comprises a rounded upper end with a flange attached, the flange being adapted for holding the head portion on the neck portion, and a squared neck portion below and adjacent to the rounded upper end; (b) a head portion which comprises a generally square aperture adapted for loosely receiving the squared neck portion, the flange having a greater diameter than the square aperture. With this swivel mechanism, the head portion is adapted for rotation about the neck portion. A user can move the doll's head around in a circle using this mechanism.

For the four-legged embodiment of the present invention, a first pair of the matching leg portions have outer faces facing in opposite directions, north and south, and a second pair of the matching leg portions have outer faces facing in opposite directions, east and west. Preferably, the body portion further comprises a central handle portion extending downwardly between the leg portions through the center of the body portion, and the handle portion extends downwardly beyond the leg portions for grasping. In this embodiment, the four leg portions are preferably of equal size and are different distances from the center handle portion, and the spaces between the leg portions and the center handle portion are adapted to accommodate text covers of different thicknesses.

In the adjustment cord embodiment, an adjustment cord is attached at one end between the leg portions and is unattached at an opposite end. The adjustment cord is adapted to be inserted between the book cover and a leg portion. Similarly, the pin/lever embodiment includes an adjustment lever which extends downwardly between two leg portions from a hollow in the central body portion, as described herein. The adjustment lever is preferably connected at an upper end to an adjustment pin mechanism adapted for moving the adjustment lever into an up position and a down position. The down position is adapted for narrowing the space between the two leg portions.

Lastly, in the clasp embodiment, one leg portion is attached to the body portion by a hinged clasp mechanism adapted for moving the leg portion from an open position to a closed position. The closed position is adapted for grasping the book cover between the leg portions. The clasp mechanism preferably comprises a hinge base section, which is attached to the base of one leg portion, two arm members, and a stop. Preferably, one end of each arm member is hinged to each side of the base section, and an opposite end of each arm member is affixed to one end of a leg segment. The stop is also affixed to the end of the leg segment between the two arm members.

From the foregoing it can be realized that the described device of the present invention may be easily and conveniently utilized as a bookmark. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS (For Information Only)

10 doll bookmark
11 head portion
12 face
13 hair strands
14 leg portion
15 book cover
16 neck portion
17 chest area
18 tab attachment
19 attachment portion
20 tab-holding portion
21 ornamental beads for hair
22 knot on strand of hair
23 central handle portion
24 front side of the torso
25 wide space between legs
26 back side of the torso
27 thin space between legs
28 medium-sized space between legs
29 ornamental hair baubles
30 head swivel mechanism
31 squared neck portion
32 square aperture
33 rounded upper end of neck portion
34 hole on top of head portion
35 adjustment cord
36 juncture between leg portions
37 adjustment lever
38 adjustment pin
39 adjustment slot
40 clasp mechanism
41 clasp hinge joint
42 pair of arm members in clasp
43 stop in clasp
44 leg segment on clasp
45 outer face of leg portion
46 inner face of leg portion
47 flange
48 flange stop

What is claimed is:

1. A bookmark in the shape of a doll or animal, comprised of:

(a) a rounded head portion;

(b) a longitudinally extending body portion attached at an upper end to the head portion, the body portion comprising at least two generally rigid, matching leg portions extending downwardly at a lower end, the leg portions being spaced apart and adapted for placement over the edge of a cover of a book or other text, wherein the body portion further comprises a neck portion at its upper end, and the head portion is movably coupled to the neck portion; and (c) at least one strand of material resembling hair, said at least one strand having one end attached to the head portion, the strand being of a length and thickness adapted for placement between two pages of the book to mark one or more pages for future reference.

2. A bookmark according to claim 1, wherein each leg portion has a generally flat inner face which is parallel to and faces the generally flat inner face of the other leg portion, the leg portions being adapted to fit closely over a book cover or booklet.

3. A bookmark according to claim 2, wherein the leg portions extend from the body portion so as to converge to an open end and to be resiliently spread when the leg portions are pushed over the cover of the book or other text, with one leg portion on either side of the book cover, and wherein the bookmark is one-piece and made of wood or plastic.

4. A bookmark according to claim 1, further comprising a head swivel mechanism adapted for rotating the head portion about the neck portion.

5. A bookmark according to claim 1, wherein a first pair of the matching leg portions have outer faces facing in opposite directions, north and south, and a second pair of the matching leg portions have outer faces facing in opposite directions, east and west.

6. A bookmark according to claim 5, wherein the body portion further comprises a central handle portion extending downwardly between the leg portions through the center of the body portion, the handle portion extending downwardly beyond the leg portions.

7. A bookmark according to claim 6, wherein the four leg portions are of equal size and are different distances from the central handle portion, and the spaces between the leg portions and the central handle portion are adapted to accommodate text covers of different thicknesses.

8. A bookmark according to claim 7, wherein the at least one strand is a plurality of strands, each of said strands being a different colored ribbon.

9. A bookmark according to claim 8, wherein tab attachments are attached to the unattached end of one or more of said strands.

10. A bookmark according to claim 9, wherein the neck portion comprises a rounded upper end with a flange adapted for holding the head portion on the neck portion, and a squared neck portion below and adjacent to the rounded upper end; wherein the head portion comprises a generally square aperture adapted for loosely receiving the squared neck portion, the rounded upper end with the flange having a greater diameter than the square aperture; and wherein the head portion is adapted for rotation about the neck portion.

11. A bookmark in the shape of a doll or animal, comprised of:

(a) a rounded head portion;

(b) a longitudinally extending body portion attached at an upper end to the head portion, the body portion comprising at least two generally rigid, matching leg portions extending downwardly at a lower end, the leg portions being spaced apart and adapted for placement over the edge of a cover of a book or other text;

(c) at least one strand of material resembling hair, each strand having one end attached to the head portion, the strands being of a length and thickness adapted for placement between two pages of the book to mark one or more pages for future reference; and (d) an adjustment cord which is attached at one end between the leg portions and is unattached at an opposite end, and wherein the adjustment cord is adapted to be inserted between the book cover and one of said leg portions.

12. A bookmark according to claim 11, wherein the at least one strand is made of wig hair twisted into dreadlocks.

13. A bookmark in the shape of a doll or animal, comprised of:

(a) a rounded head portion;

(b) a longitudinally extending body portion attached at an upper end to the head portion, the body portion comprising at least two generally rigid, matching leg portions extending downwardly at a lower end, the leg portions being spaced apart and adapted for placement over the edge of a cover of a book or other text;

(c) at least one strand of material resembling hair, each strand having one end attached to the head portion, the strands being of a length and thickness adapted for placement between two pages of the book to mark one or more pages for future reference; and (d) an adjustment lever extending downwardly between the two leg portions from a hollow in the body portion, the adjustment lever being connected at an upper end to an adjustment pin mechanism adapted for moving the adjustment lever into an up position and a down position, the down position being adapted for narrowing the space between the two leg portions.

14. A bookmark according to claim 13, wherein the at least one strand is a plurality of strands braided into one or more braids, the one or more braids being of a length and thickness adapted for placement between two pages of the book to mark one or more pages for future reference.

* * * * *